United States Patent [19]

Becker

[11] Patent Number: 5,063,843

[45] Date of Patent: Nov. 12, 1991

[54] SHEET-FED ROTARY PRINTING MACHINE FOR PRODUCING SINGLE-SIDED MULTI-COLOR PRINTING OR PERFECTOR PRINTING

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 581,076

[22] Filed: Sep. 10, 1990

Related U.S. Application Data

[63] Continuation of Ser. No. 442,410, Nov. 27, 1989, abandoned, which is a continuation of Ser. No. 174,090, Mar. 28, 1988, abandoned.

[30] Foreign Application Priority Data

Mar. 28, 1987 [DE] Fed. Rep. of Germany ..... 3710257

[51] Int. Cl.[5] ..... B41F 21/10; B41F 502

[52] U.S. Cl. ..... 101/183; 101/230

[58] Field of Search ..... 101/230, 231, 411, 412, 101/409, 410, 183, 246, 184, 409–411, 185, 177; 271/82, 184, 186, 902

[56] References Cited

U.S. PATENT DOCUMENTS 4,026,209 5/1977 Wirz et al. ..... 101/231

FOREIGN PATENT DOCUMENTS 2305132 10/1974 Fed. Rep. of Germany .
3413158 10/1985 Fed. Rep. of Germany .
3535694 4/1987 Fed. Rep. of Germany ..... 101/230
219058 12/1983 Japan ..... 101/230

*Primary Examiner*—J. Reed Fisher
*Attorney, Agent, or Firm*—Herbert L. Lerner; Laurence A. Greenberg

[57] ABSTRACT

A sheet-fed rotary printing machine for producing single-sided multi-color printing or perfector printing having a sheet-transfer cylinder disposed in travel direction of a sheet between impression cylinders of a first and a second printing unit, and having gripper systems assigned to all of the cylinders, includes a device defining a transfer gap between the sheet-transfer cylinder and the impression cylinder of the second printing unit, a device for enlarging the width of the transfer gap in relation to a normal gap width to the impression cylinder of the first printing unit, a gripper system having a device for bridging the enlarged width of the transfer gap, the gripper system being movable out of the circumference of the sheet-transfer cylinder so as to grip a leading or trailing edge of the sheet and transfer the gripped sheet to the outer cylindrical surface of the impression cylinder, and a device for driving the sheet-transfer cylinder and the following impression cylinder at identical circumferential speeds.

8 Claims, 8 Drawing Sheets

38
33
34
44
32
36
42
43
6
47
36'
25"
7'
26
35
13
7
30
9

SHEET-FED ROTARY PRINTING MACHINE FOR PRODUCING SINGLE-SIDED MULTI-COLOR PRINTING OR PERFECTOR PRINTING

This application is a continuation of application Ser. No. 442,410, filed Nov. 27, 1989, now abandoned, which is a continuation of application Ser. No. 174,090, filed March 28, 1988, now abandoned.

The invention relates to a sheet-fed rotary printing machine and, more particularly, to such a printing machine for a sheet-fed rotary printing machine for producing single-sided multi-color printing or perfector printing having a sheet-transfer cylinder disposed in travel direction of a sheet between impression cylinders of a first and a second printing unit, and having gripper systems assigned to all of the cylinders.

Such a sheet-fed rotary printing machine is known from German Published Prosecuted Application (DE-AS) 2 305 132, in which an impression cylinder of a second printing unit, viewed in the direction of travel of a sheet, has four rows of grippers, two of which, respectively, being singable towards one another and cooperate in such a manner that two rows of grippers are disposed pairwise diametrically opposite one another. For two-sided printing on the sheet, the sheet having been accepted by the grippers of the sheet-transfer cylinder from the clamp-type grippers of the impression cylinder of the first printing unit is moved across a line of contact between the sheet-transfer cylinder and the impression cylinder of the second printing unit, and the trailing edge of the sheet is then gripped by the clamp-type grippers of the impression cylinder of the second printing unit. During the further movement of this impression cylinder, the corresponding pairs of grippers are swung approximately 90° inwards and towards one another, with the sheet being transferred by its trailing edge from one set of grippers to the other and being conveyed by the latter, with a simultaneous outward-swinging of the corresponding grippers, to the printing line. A disadvantage of this converted construction is that, when perfecting, it is not possible to process a small size or format.

An object of the invention of the instant application is to optimize the construction and operation of a sheet-fed rotary printing machine of the foregoing general type, particularly so that the impression surface of the impression cylinder is fully appropriate for maximum sheet size or format, and permits as well, smear-free perfecting of all small sheet formats with the gripper systems and the grippers being of stable construction while attaining great holding forces.

With the foregoing and other objects in view, there is provided, in accordance with the invention, a sheet-fed rotary printing machine for producing single-sided multi-color printing or perfector printing having a sheet-transfer cylinder disposed in travel direction of a sheet between impression cylinders of a first and a second printing unit, and having gripper systems assigned to all of the cylinders, comprising means defining a transfer gap between the sheet-transfer cylinder and the impression cylinder of the second printing unit, means for enlarging the width of the transfer gap in relation to a normal gap width to the impression cylinder of the first printing unit, a gripper system having means for bridging the enlarged width of the transfer gap, the gripper system being movable out of the circumference of the sheet-transfer cylinder so as to grip a leading or trailing edge of the sheet and transfer the gripped sheet to the outer cylindrical surface of the impression cylinder, and means for driving the sheet-transfer cylinder and the following impression cylinder at identical circumferential speeds.

In accordance with another feature of the invention, there are provided pincer-type grippers projecting out of the impression cylinder, the pincer-type grippers being swingable around out of a position thereof wherein a clamping mouth of the pincers is pointed in the direction of rotation of the impression cylinder into a position wherein the clamping mouth of the pincers is directed opposite to the direction of rotation of the impression cylinder, after the trailing edge of the sheet has been gripped and prior to reaching a position opposite a rubber-covered cylinder of the second printing unit.

In accordance with a further feature of the invention, there is provided a corrected gear pair for equalizing different center-to-center distances of the impression cylinders of the two printing units with respect to the sheet-transfer cylinder.

In accordance with an added feature of the invention, a pitch-circle of a driven gear ring on a shaft of the first printing unit has a smaller radius than that of a gear ring of the second printing unit, the gear rings having identical numbers of teeth.

In accordance with an additional feature of the invention, the pincer-type grippers are adjacent to one of two gripper-bar arrangements disposed in a common recess formed in the impression cylinder and, after the pincer-type grippers have swung around into a direction opposite to the direction of rotation of the impression cylinder, the sheet is insertable by the trailing edge thereof into the one gripper-bar arrangement.

In accordance with again another feature of the invention, there are provided means assigned to the sheet-transfer cylinder for directing a blowing-air stream radially outwards and upwards and towards an upper-side guide plate, the blowing-air stream serving to lift off the sheet held by the pincer-type grippers in the direction of the underside of the guide plate.

In accordance with again a further feature of the invention, there are provided suction-air nozzles for holding the sheet trailing edge section directly beyond an end section thereof which extends freely into a recess formed in the sheet-transfer cylinder.

In accordance with a concomitant feature of the invention, the pincer-type grippers are carried by a shaft, and including a toothed segment for rotating the last-mentioned shaft.

Such a construction results in a sheet-fed rotary printing machine of the initially afore-described general type having a high utility value. Also, when perfecting, it is possible to process all small formats therewith, and, in fact, with a full impression surface of the impression cylinder of the second printing unit. The enlarged transfer gap between the sheet-transfer cylinder and the impression cylinder of the second printing unit makes it possible for the grippers of the sheet-transfer cylinder to pass through the gap without damaging the impression cylinder of the second printing unit. If the sheet-fed rotary printing machine has been set up for single-sided printing, the pincer-type gripper protecting out of the impression cylinder and bridging the transfer gap accepts the leading edge of the sheet and then swings with the sheet onto the periphery of the impression cylinder. For this purpose, the mouths of the pincers point in a direction opposite to the direction of rotation of the impression cylinder. If, after passing through the first printing unit, the sheet is to be printed on the reverse side, it is necessary to turn the sheet. Before reaching the connecting line between the transfer drum and the impression cylinder, the pincer-type grippers assume a position wherein the mouths of their pincers point in the direction of rotation of the impression cylinder.

By opening and bridging the transfer gap, the pincer-type grippers are then able to grip the trailing edge of the sheet which projects freely into the recess of the sheet-transfer cylinder. The pincer-type grippers then execute a pivoting movement, with the result that the mouths of the pincers then point in a direction opposite to the direction of rotation of the impression cylinder. This pivoting movement, however, has already been completed before the position opposite the rubber-covered cylinder of the second printing unit is reached. In this manner, the trailing edge of the sheer is treated gently. The corrected gear pair ensures that the impression cylinders will revolve at identical speeds in spite of different center-to-center distances of the impression cylinders of both printing units with respect to the sheet-transfer cylinder. This is achieved in a particularly advantageous manner by the fact that the pitch circle of the driven gear ring on the shaft of the impression cylinder of the first printing unit has a smaller radius than that of the gear ring of the second printing unit, with the gear rings having identical numbers of teeth. The holding forces to the sheet on the impression cylinder of the second printing unit are increased by a second gripper-bar arrangement. This additionally comes into engagement after the the trailing edge of the sheet has been gripped and, accordingly, increases the desired holding force on the sheet. Smearing of the sheet during transfer and prior to printing of the second side is prevented by the blowing-air stream associated with the sheet-transfer cylinder, directed radially outwards and upwards and towards an upper-side guide plate, the blowing-air stream lifting the sheet held by the pincer-type grippers off the sheet-transfer cylinder and moving it in the direction of the underside of the guide plate. Before the trailing edge of the sheet is gripped, it must always remain steady in a specified position. This is achieved by the fact that the sheet trailing edge section is held by suction-air holes, directly beyond the end section thereof which extends freely into the recess of the sheet-transfer cylinder. The pincer-type grippers gripping the trailing edge of the sheet can be controlled in a relatively simple manner, for which purpose they are carried by a shaft which is rotatable by a toothed segment. The pivoting of the toothed segment leads of necessity to the swinging round of the pincer-type grippers, so that the mouths of the pincers then come into the opposite position with respect to the direction of rotation of the impression cylinder. The pivoting of the toothed segment is accomplished, for example, by a cam control associated with the impression cylinder of the second printing unit.

Other features which are considered as characteristic for the invention are set forth in the appended claims.

Although the invention is illustrated and described herein as embodied in a sheet-fed rotary printing machine for producing single-sided multi-color printing or perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
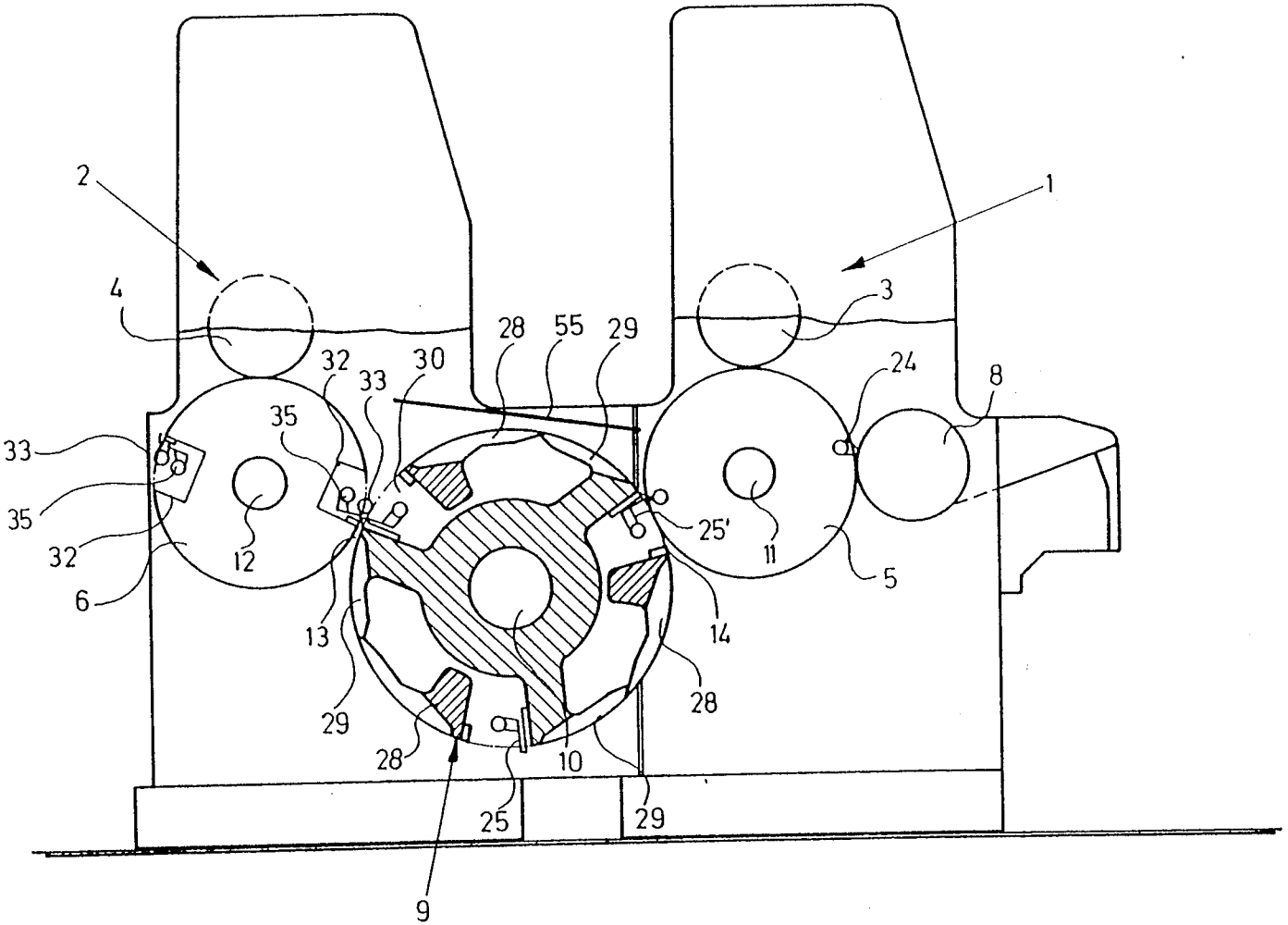
FIG. 1 is a diagrammatic view, partly in section, of a sheet-fed rotary printing machine with two in-line printing units, set up for one-sided sheet printing.

Referring now to the drawing and, first, particularly to FIG. 1 thereof, there is shown a sheet-fed rotary printing machine formed of two in-line printing units 1 and 2. Of each printing unit 1 and 2, the rubber-covered cylinder 3 and 4, respectively, and the impression cylinder 5 and 6, respectively, are shown. In a conventional manner, non-illustrated plate cylinders and inking units are associated with the rubber-covered cylinders 3 and 4.

Sheets 7 which are to be printed are supplied in a conventional manner by a feeding cylinder 8, disposed on the input side of the machine, to the impression cylinder 5 of the first printing unit 1 and are removed, likewise in a conventional manner, from the impression cylinder 6 by a delivery cylinder.

Disposed between the impression cylinders 5 and 6 of the two printing units 1 and 2 is a sheet-transfer cylinder 9, having a rotary shaft 10 which is situated below the shafts 11 and 12 of the impression cylinders 5 and 6. The diameter of the sheet-transfer cylinder 9 is three times as large as that of the rubber-covered cylinder 3 and 4. Conversely, the impression cylinders 5 and 6 have diameters twice as large as that of the rubber-covered cylinders 3 and 4. Accordingly, the impression cylinders 5 and 6 and the sheet-transfer cylinder 9 are capable of accepting two and three sheets 7, respectively.

Figure 4:
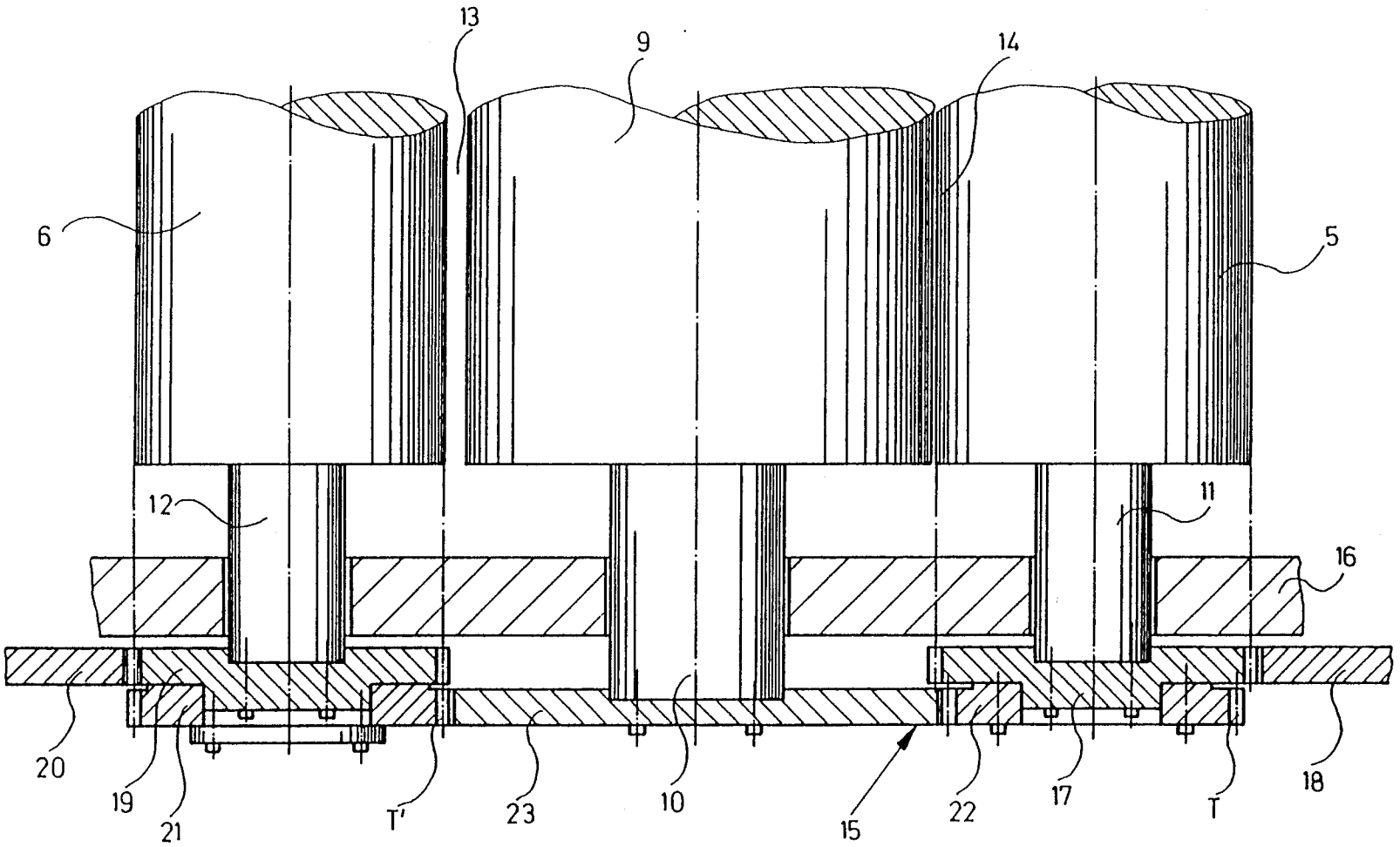
FIG. 4 is a fragmentary somewhat enlarged plan view of FIG. 3 showing the drive side of the cylinders which are supported at one end in an end wall of the machine frame, and illustrating the corrected pair of gears.

A transfer gap 13 between the impression cylinder 6 of the second printing unit 2 and the sheet-transfer cylinder 9 is enlarged in relation to the normal gap 14 between the impression cylinder 5 of the first printing unit 1 and the sheet=transfer cylinder 9. This transfer gap 13 is approximately five to seven mm wide. To ensure that the two impression cylinders 5 and 6 will revolve at identical rotational speeds, a corrected gear pair 15 is provided. The latter equalizes the different center-to-center distances of the impression cylinders 5 and 6 of the two printing units 1, 2 with respect to the rotary shaft 10 of the sheet-transfer cylinder 9. More specifically, the shaft 11, held at one end in an end wall 16 of the machine frame FIG. 4, is equipped at the end face with a gear 17. The pitch-circle diameter or the gear 17 corresponds to the outer diameter of the impression cylinder 5. The gear 17 meshes with transmission gear 18.

Seated on the shaft 12 of the other impression cylinder 6, the shaft 12 passing through the end wall 16, is likewise a gear 19 having a pitch-circle diameter which corresponds to the diameter of the impression cylinder 6 and meshes with a transmission gear 20 leading to the rubber-covered cylinder 4. A gear ring 21 is connected to the gear 19 so as to be fixed against rotation relative thereto, through the intermediary of a clamp-type connection, which is loosenable for adjusting the format. The pitch-circle diameter T' of the gear ring 21 is also of the size of the diameter of the impression cylinder 6. This gear ring 21 cooperates with the corrected gear pair 15. The latter is made up of a drive gear ring 22 connected ro the gear 17 so as to be fixed against rotation relative thereto, and a middle gear 23 seated at the end of the rotary shaft 10. The pitch-circle T of the drive gear ring 22 of the impression cylinder 5 has a smaller radius than that of the other gear ring 21. However, both gear rings 21 and 22 have the same number of teeth. Accordingly, this drive gear ring 22 is subject to an appropriate correction when the teeth are being machined. Likewise, a correction is made to the middle gear 23, the pitch-circle diameter of which is slightly larger than the diameter of the sheet-transfer cylinder 9.

The sheet 7 is held on the impression cylinder 5 of the first printing unit 1 by two rows of clamp-type grippers 24 and 24', which are disposed diametrically opposite one another on the impression cylinder 5 and which grip the leading edge 7' of the sheet.

The sheet-transfer cylinder 9 is equipped with three clamp-type grippers 25, 25' and 25'', which are distributed at equal angles from one another. These clamp-type grippers accept the leading edge of the sheet 7' from the clamp-type grippers 24 and 24' and hold it against a clamping plate 26.

The clamp-type grippers 25, 25' and 25'' are accommodated in sheet section-shaped cutouts 27 of the sheet-transfer cylinder 9, in which there are disposed segments 28, which are adjustably aligned with the periphery of the transfer cylinder 9. These segments 28 mesh with fingers 29 of the sheet-transfer cylinder 9, with the outer surfaces of these fingers 29 aligning with the periphery of the cylinder 9. The segments 28 terminate at a spaced distance from the clamp-type grippers 25, 25' and 25'' and thus form three recesses 30, which are distributed at equal angles from one another. Situated at the trailing ends of the segments 28 are suction-air nozzles 31, which hold the sheet trailing edge section 7'' beyond the end section 7''', which extends freely into the recess 30.

One row of pincer-type grippers 33 is held in each of two diametrically opposite recesses 32 of the impression cylinder 6 of the printing unit 2. The swivel axis 34 of the pincers extends somewhat on the periphery of the impression cylinder 6. Assigned to this row of pincer-type grippers 33 is a second gripper-bar arrangement 35, which is made up of juxtaposed clamp-type grippers 36, each of which extends between two adjacent pincer-type grippers 33. Clamping plates 37 located at the printing roller side are situated opposite hook-like ends 36' of the clamp-type grippers. The clamp-type grippers 36 are mounted so as to be able to swivel about a shaft 38 of the impression cylinder 6. Arms 40, which are equipped with a roller 39, extend from the clamp-type grippers 36. During the rotation of the impression cylinder 6, the roller 39 rolls on a cam track 41, as a result of which the clamp-type grippers 36 are moved into the open and closed positions.

The swivel shaft 34 of the pincers is rigidly connected to one pincer jaw 42, while the other pincer jaw 43 is seated on a hollow shaft 44 holding the swivel shaft of the pincers. One end of the hollow shaft 44 is equipped with a radially toothed gear 45 which meshes with the teeth of a toothed segment 46. This toothed segment 46 provided on one side of the impression cylinder 6, is held about one end of a shaft 47 of the impression cylinder 6 and is equipped on a projection 46' with a sensing roller 48, which, in turn, rolls on a fixed cam track 49 of the one end wall 16. Another toothed segment 51, likewise provided with a sensing roller 50, is held at the other end of the shaft 47. This toothed segment 51 meshes with a gearwheel 52 mounted on the swivel shaft 34. As the impression cylinder 6 rotates, the sensing roller 50 rolls on a control cam 53 of the other end wall 16'. In contrast to the toothed segment 51, the toothed segment 46 forms a bow-shaped slot 54, extending concentrically with respect to the shaft 47, for the passage of the shaft 38. It is thereby possible for the pincer-type grippers 33, in addition to being able to perform opening and closing movements, to also be able to swing around in such a manner that the pincer mouths M thereof are able ro point either in or opposite to the direction of rotation of the impression cylinder.

Figure 2:
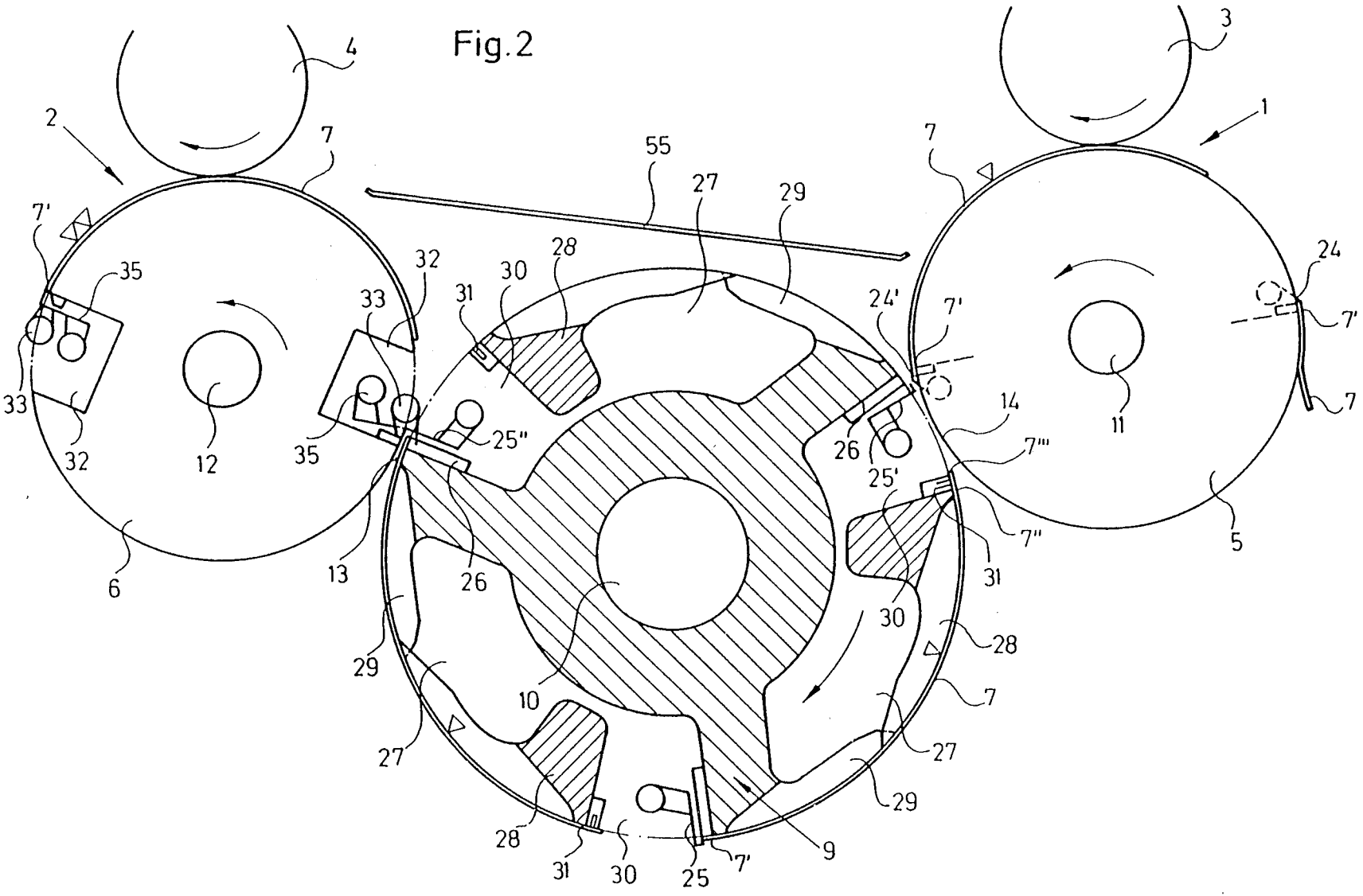
FIG. 2 is a fragmentary enlarged view of FIG. 1 showing in greater detail the sheet-transfer cylinder with the adjacent impression cylinders, also related to one-sided sheet printing.
Figure 5:
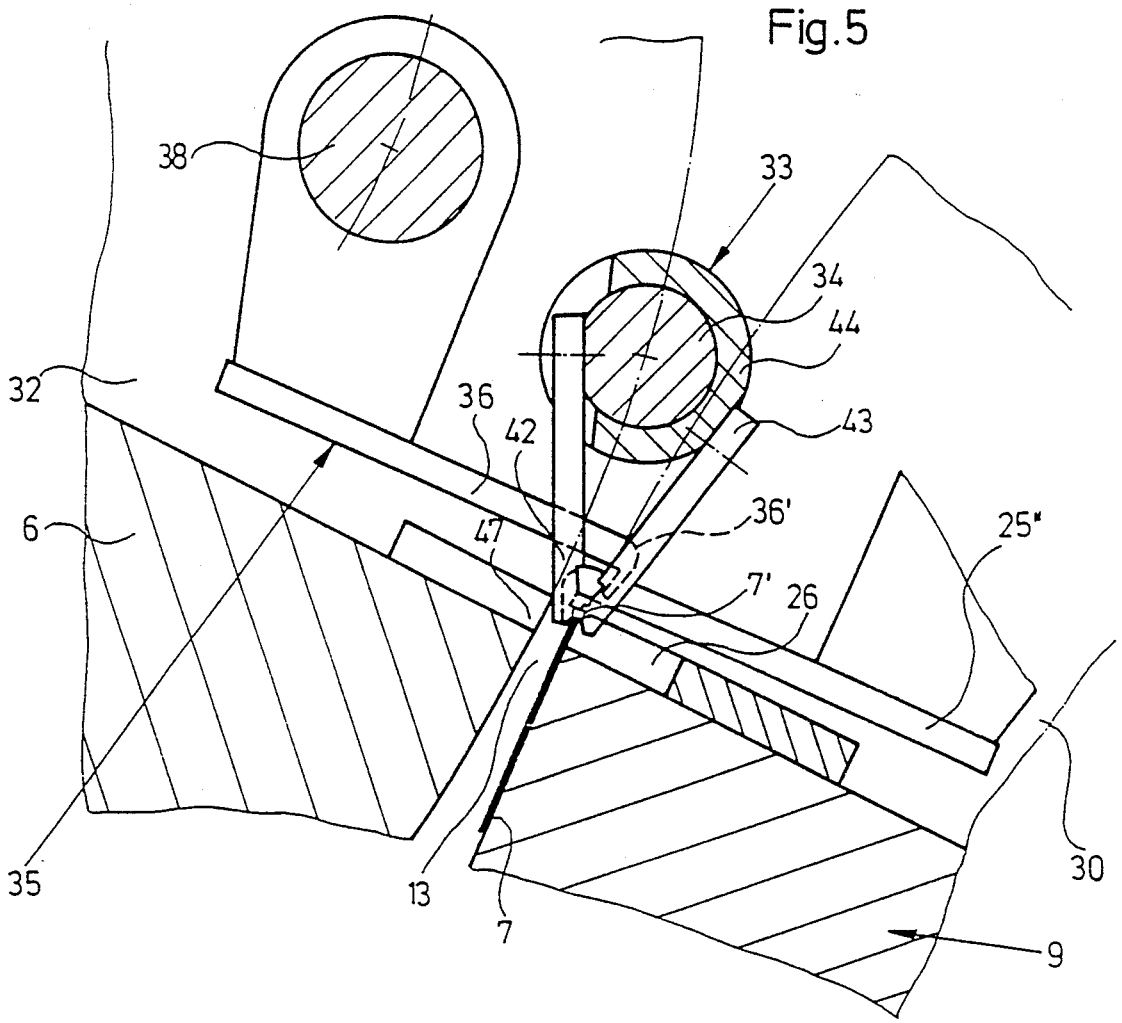
FIG. 5 is an enlarged fragmentary sectional view of FIG. 2 showing, in approximately actual size, in the region of the transfer gap between sheet-transfer cylinder and impression cylinder of the second printing unit, with the pincer-type grippers gripping the leading edge of the sheet and with the adjacent gripper-bar arrangement in released position.
Figure 6:
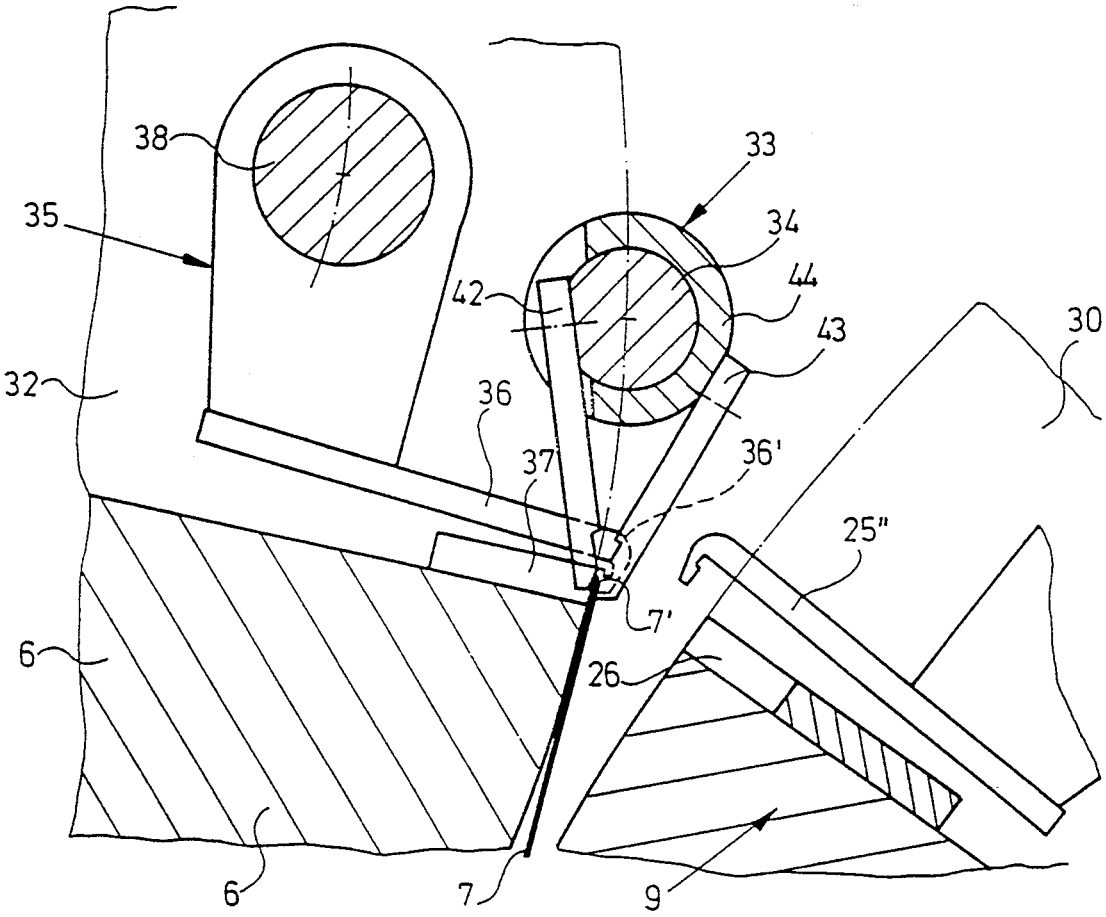
FIG. 6 is another view similar to that of FIG. 5, however, in a further rotated position wherein the gripper-bar arrangement additionally grips the leading edge of the sheet.
Figure 7:
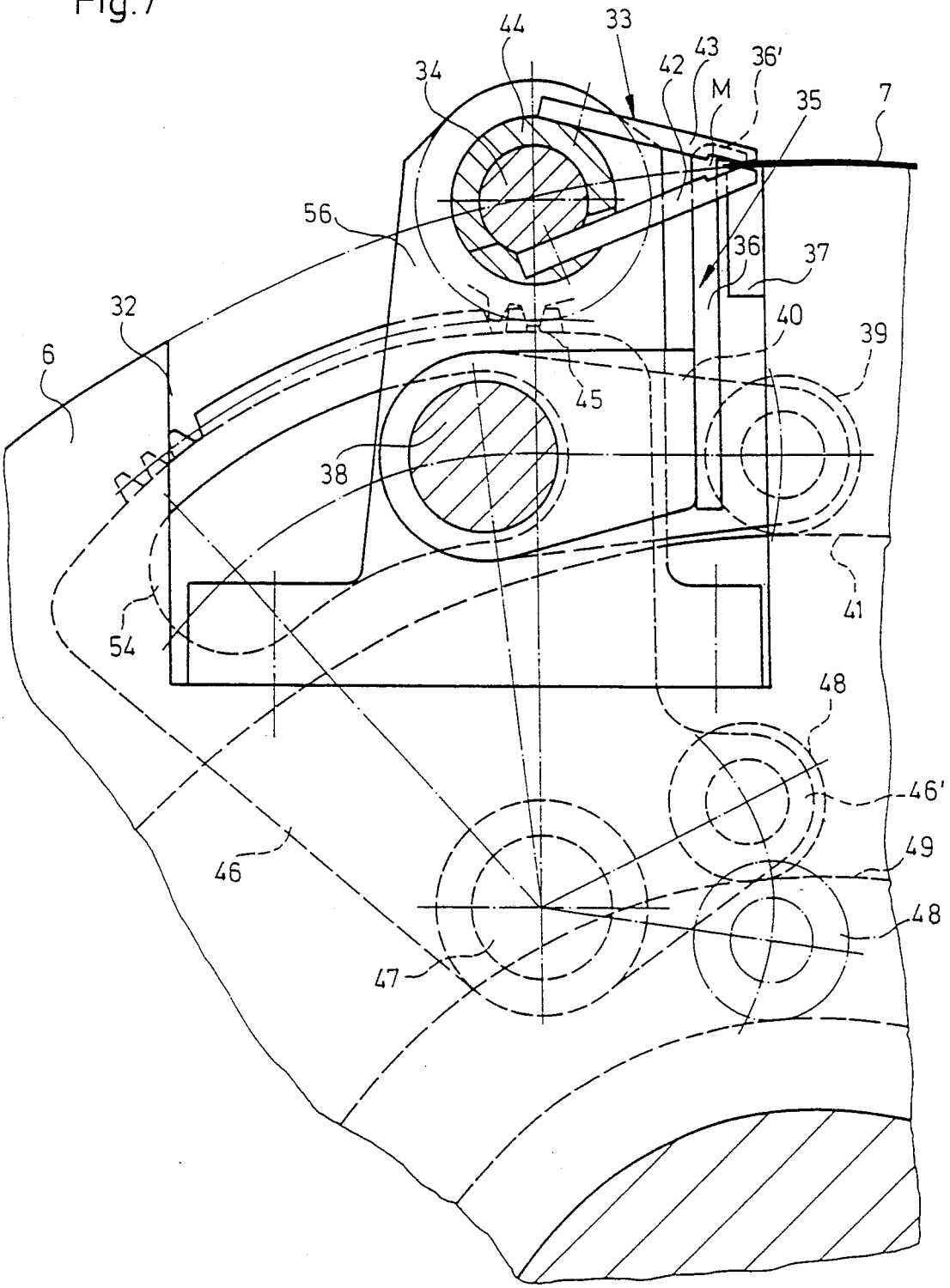
FIG. 7 is a fragmentary front view of the impression cylinder of the second printing unit in the vicinity of the toothed segment assigned to the pincer-type grippers, and corresponding to the captured position of the sheet.
Figure 8:
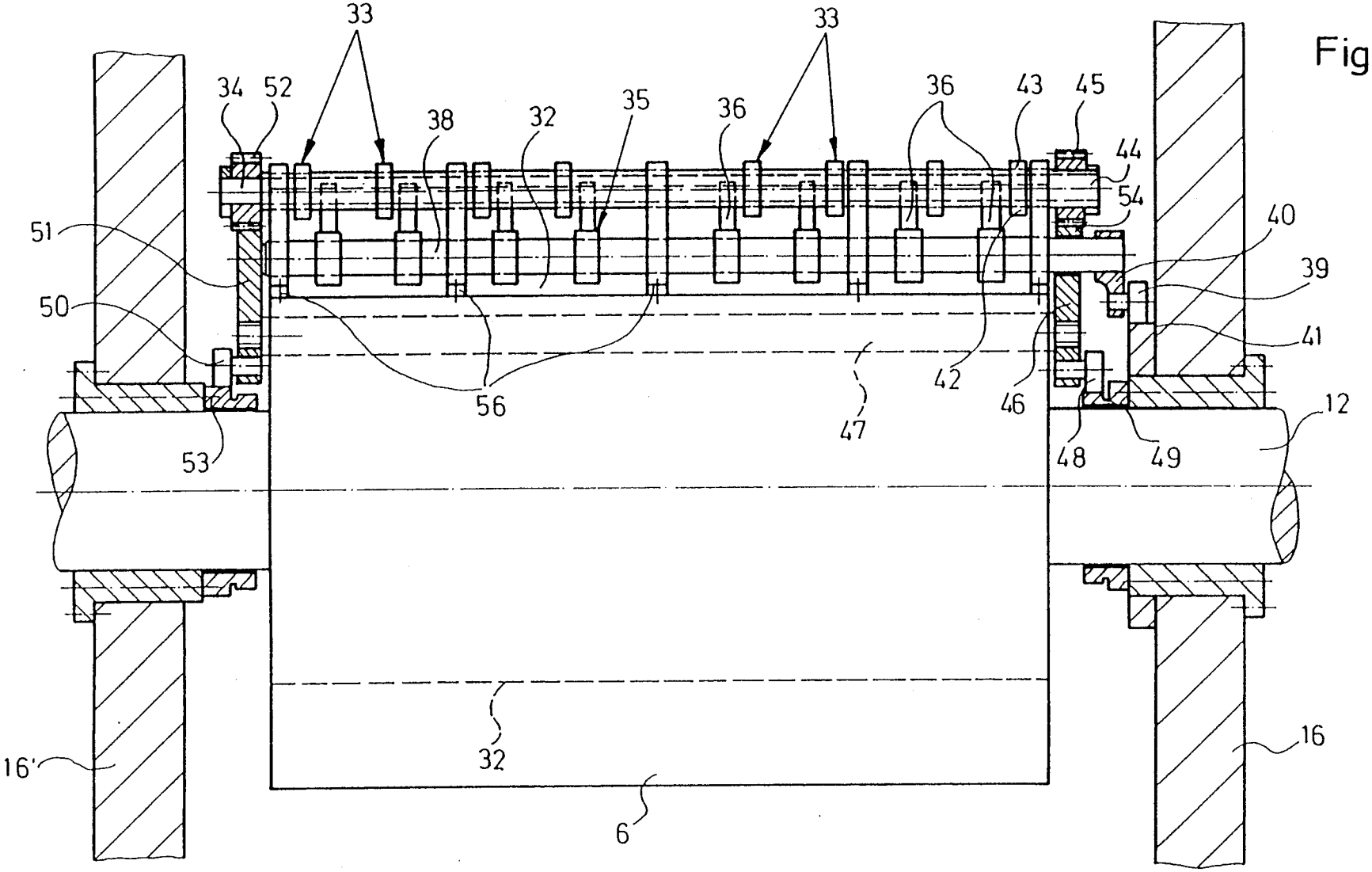
FIG. 8 is a top plan view, partly in section, of the impression cylinder with gripper systems carried thereby.

The operating principle of the invention is as follows: when a sheet 7 is printed in single-sided printing, note in particular FIGS. 2, 5 and 7, the sheets 7 are transferred from the clamp-type grippers 24 and 24' of the first impression cylinder 5 to the clamp-type grippers 25, 25' and 25'' of the sheet-transfer cylinder 9 in such a manner that the latter grippers hold the leading edge of the sheet 7' against the clamping plates 26. The sheet trailing edge section 7''', in turn, is captured by the suction-air nozzles 31 in such a manner that an end section 7''' still projects into the recess 30. Approximately at the level of the connecting line between the sheet-transfer cylinder 9 and the impression cylinder 6, the pincer-type grippers 33 facing the clamp-type grippers 25'' assume such a position that the clamping mouths M thereof are directed opposite to the direction of rotation of the impression cylinder 6. Furthermore, the pincer-type grippers are swivelled by a small extent, bridging the transfer gap 13, note FIG. 5 especially. Consequently, the leading edge of the sheet 7'comes between the pincer jaws 42 and 43. In this position, the adjacent clamp-type gripper 36 of the gripper-bar arrangement 35 is open. During further rotation, the clamp-type gripper 25'' of the sheet-transfer cylinder 9 opens, see FIG. 6, while the clamp-type gripper 36 of the impression cylinder 6 closes. The leading edge of the sheet 7' is now held both by the pincer-type grippers 33 and also by the gripper-bar arrangement 35, with the second print being made on the same side in the region of contact between the rubber-covered cylinder 4 and the impression cylinder 6. The next sheet 7 held by the clamp-type grippers 25, is then conveyed in the same manner via the other pincer-type grippers into the second printing unit for printing.

Figure 3:
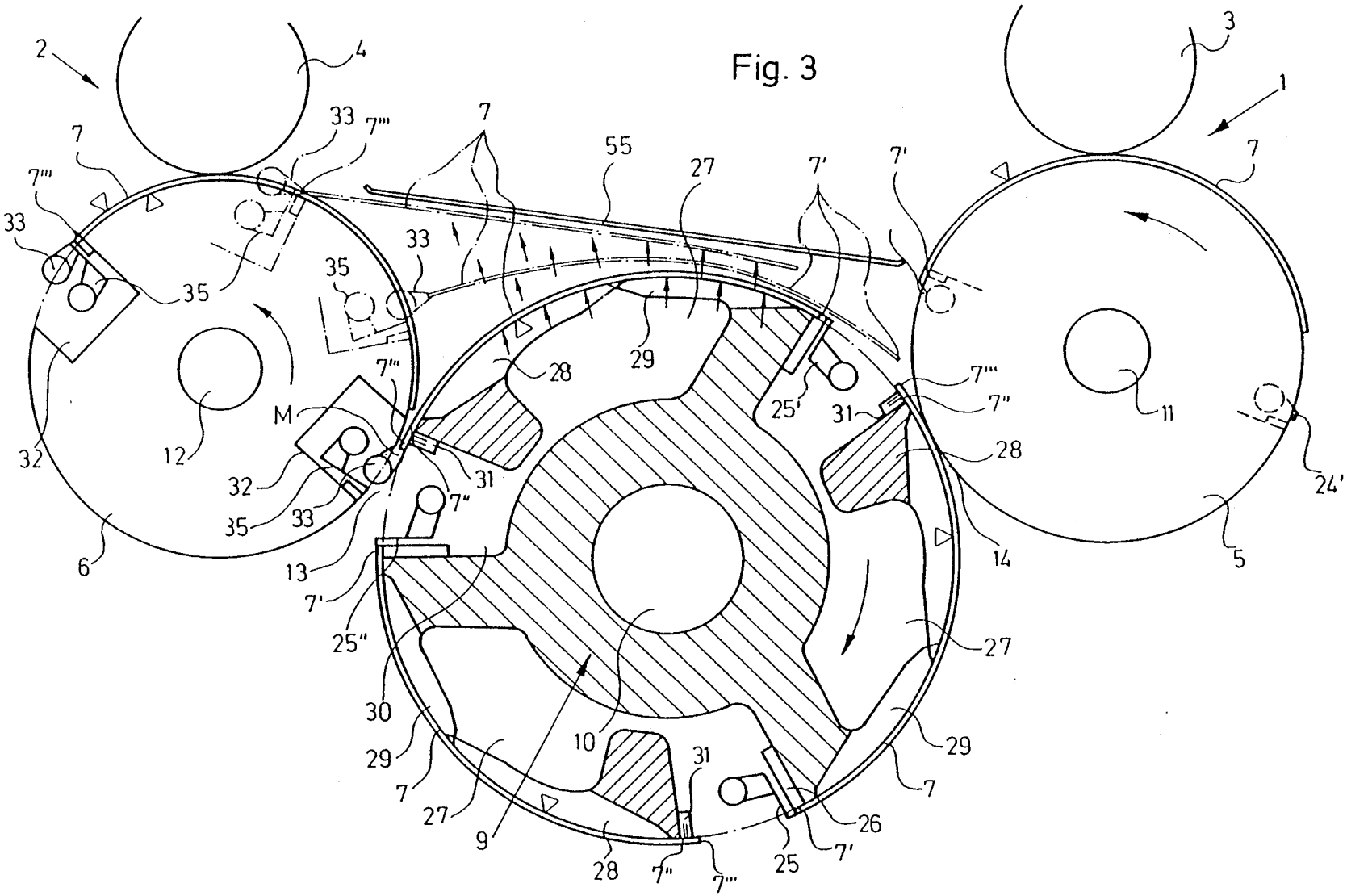
FIG. 3 is a view like that of FIG. 2 showing the printing machine set up for perfector printing.

If, after the printing of the sheet 7 in the printing unit 1, the reverse side of the sheet 7 is also to be printed, the control of the pincer-type grippers is to be set up so that the pincer-type grippers 33, which are situated approximately at the level of the connecting line between the impression cylinder 6 and the sheet-transfer cylinder and which are adjacent to the transfer gap 13, point with their clamping mouths M in the direction of rotation of the impression cylinder 6. The transfer gap 13 is bridged by a slight turning of the pincer-type grippers, so that the trailing edge of the sheet, projecting freely into the recess 30 of the sheet-transfer cylinder 9, or the adjoining end section 7''' can be gripped by the pincer-type grippers 33. For this purpose, the suction-air nozzles 31 release the sheet trailing edge section 7''. At the same time, the sheet 7, which is held by the pincer-type grippers 33, is lifted off in the direction of the underside of the guide plate 55 by a blowing-air stream assigned to the sheet-transfer cylinder 9, directed radially outwards and upwards and towards an upper-side guide plate or guide tongue 55 note the phantom views in FIG. 3. During this operation, the toothed segments 46 and 51 are swivelled, with the pincer-type grippers 33 being swung round out of the position thereof in which the clamping mouth M of the pincer is pointed in the direction of rotation of the impression cylinder 6, after gripping the trailing edge of the sheet and before reaching the position opposite the rubber-covered cylinder 4 of the second printing unit 2, into a position thereof wherein the direction of the mouth of the pincer is opposite to the direction of rotation of the impression cylinder. After swing-round has taken place, likewise before reaching this position opposite the rubber-covered cylinder of the second printing unit, the adjacent gripper-bar arrangement 35 comes into the clamping position with respect to the bottom edge of the sheet. The blowing-air stream illustrated by the arrows in FIG. 3 prevents smearing of the side which has already been printed.

After appropriate printing of the sheet, the pincer-type grippers 33 and clamp-type grippers 36 release the sheet 7, so that it can be removed from the impression cylinder 6 in a conventional manner by a delivery cylinder.

The embodiment shown in FIG. 1 illustrates the sheet-turning station in a two-color printing unit or between the first pair of printing units of a multi-color printing machine. The sheet-turning station may also be provided between further pairs of printing units of a multi-color offset printing machine.

The foregoing is a description corresponding in substance to German Application P 37 10 257.5, dated March 28, 1987, the International priority of which is being claimed for the instant application, and which is hereby made part of this application.

I claim:

1. Sheet-fed rotary printing machine for producing single-sided multi-color printing or perfector printing comprising a first and a second printing unit, respectively including an impression cylinder, a single sheet-transfer cylinder disposed in travel direction of a sheet between said impression cylinder of said first and said second printing unit, said single sheet-transfer cylinder and said impression cylinder of said second printing unit having a transfer gap therebetween, said transfer gap having a width larger in relation to a given width of a gap between the single sheet-transfer cylinder and said impression cylinder of said first printing unit, a gripper system mounted in said impression cylinder of said second printing unit and including means extensible into the circumference of said single sheet-transfer cylinder for bridging the enlarged width of said transfer gap, means for moving said gripper system out of the circumference of said single sheet-transfer cylinder so as to grip a leading or trailing edge of the sheet and transfer the gripped sheet to the outer cylindrical surface of said impression cylinder of said second printing unit, and means for driving the sheet-transfer cylinder and said impression cylinder of said second printing unit at identical circumferential speeds.

2. Sheet-fed rotary printing machine according to claim 9, including a rubber-covered cylinder adjacent said impression cylinder of said second printing unit, pincer-type grippers projecting out of said impression cylinder of said second printing unit, and means for swinging said pincer-type grippers around out of a first position thereof wherein a clamping mouth of the pincers is pointed in the direction of rotation of said impression cylinder of said second printing unit into a second position wherein the clamping mouth of the pincers is directed opposite to the direction of rotation of the impression cylinder of said second printing unit, after the trailing edge of the sheet has been gripped and prior to reaching a position opposite said rubber-covered cylinder of said second printing unit.

3. Sheet-fed rotary printing machine according to claim 1 including a gear pair for equalizing different center-to-center distances of the impression cylinders of the two printing units with respect to the sheet-transfer cylinder.

4. Sheet-fed rotary printing machine according to claim 2, including a driven gear ring mounted on a shaft of said first printing unit and a gear ring mounted on a shaft of said second printing unit, said driven gear ring having a smaller radius than that of said gear ring of said second printing unit, both of said gear rings having identical numbers of teeth.

5. Sheet-fed rotary printing machine according to claim 2, including an upper-side guide plate located above said sheet-transfer cylinder, and means disposed on said sheet-transfer cylinder for directing a blowing-air stream radially outwards and upwards and towards said upper-side guide plate, said blowing-air stream serving to lift off the sheet held by the pincer-type grippers in the direction of the underside of said guide plate.

6. Sheet-fed rotary printing machine according to claim 2 including suction-air nozzles mounted on said sheet-transfer cylinder for holding the sheet trailing edge section directly beyond an end section thereof which extends freely into a recess formed in said sheet-transfer cylinder.

7. Sheet-fed rotary printing machine according to claim 2, including two gripper-bar arrangements disposed in a common recess formed in said impression cylinder of said second printing unit, said pincer-type grippers being adjacent to one of said two gripper-bar arrangements, and means for inserting the sheet by the trailing edge thereof into said one gripper-bar arrangement after said pincer-type grippers have been swung around into said second position thereof.

8. Sheet-fed rotary printing machine according to claim 2, including a gripper shaft disposed at the periphery of said impression cylinder of said second printing unit, said pincer-type grippers being carried by said shaft, and including a toothed segment secured to said shaft and engageable by another toothed segment for rotating said shaft.

* * * * *